US005091074A

United States Patent [19]

Maxwell et al.

[11] Patent Number: 5,091,074

[45] Date of Patent: Feb. 25, 1992

[54] PROCESS FOR PRODUCING GASOLINE COMPONENTS

[75] Inventors: Ian E. Maxwell; Gerrit J. Den Otter, both of Amsterdam, Netherlands

[73] Assignee: Shell Oil Company, Houston, Tex.

[21] Appl. No.: 682,174

[22] Filed: Apr. 9, 1991

[30] Foreign Application Priority Data

Jun. 18, 1990 [GB] United Kingdom ..... 9013565

[51] Int. Cl.[5] ..... C10G 59/00

[52] U.S. Cl. ..... 208/79; 208/66; 208/78; 208/80; 208/93; 208/95; 208/133; 208/134; 585/302; 585/303; 585/304; 585/737

[58] Field of Search ..... 208/62, 66, 78, 79, 208/80, 93, 95, 133, 134; 585/302, 303, 304, 737

[56] References Cited

U.S. PATENT DOCUMENTS 3,753,891 8/1973 Graven et al. ..... 208/79

3,761,392 9/1973 Pollock ..... 208/93

*Primary Examiner*—Theodore Morris

*Assistant Examiner*—William C. Diemler

*Attorney, Agent, or Firm*—Kimbley L. Muller

[57] ABSTRACT

A process for producing gasoline components from a hydrocarbonaceous feed containing hydrocarbons comprising at least 4 carbon atoms is disclosed. The process comprises the following steps:

a) separating feed into a heavy fraction containing hydrocarbons comprising at least 7 carbon atoms, an intermediate fraction containing mainly hydrocarbons comprising 6 or 7 carbon atoms, and a light fraction containing hydrocarbons comprising at most 6 carbon atoms, b) isomerizing at least part of the light fraction, c) combining effluent of step b) with the intermediate fraction, separating off a stream containing normal hydrocarbons and a stream containing branched hydrocarbons, and d) passing at least part of the stream containing normal hydrocarbons to isomerization step b).

10 Claims, 2 Drawing Sheets

PROCESS FOR PRODUCING GASOLINE COMPONENTS

FIELD OF THE INVENTION

The present invention is concerned with producing gasoline components from a hydrocarbonaceous feed containing hydrocarbons comprising 4 carbon atoms and higher boiling hydrocarbons.

BACKGROUND OF THE INVENTION

In U.S. Pat. No. 3,761,392 a process is described for the production of gasoline components. In this process a hydrocarbonaceous feed is separated into a first fraction containing hydrocarbons comprising 5 carbon atoms and a second fraction containing hydrocarbons comprising at least 6 carbon atoms. The first fraction is subjected to catalytic isomerization. The second fraction is subjected to catalytic reforming. By reforming the second fraction containing 6 carbon atoms, a considerable amount of benzene is being formed. It is now foreseen that for environmental reasons the allowed benzene content of gasoline will have to be reduced. On the other hand, benzene has a relatively high octane number. Hence, it will become increasingly necessary to replace benzene by other less harming, high octane components. Such components are produced in accordance with the present process.

DESCRIPTION OF THE INVENTION

The present invention relates to a process for producing gasoline components from a hydrocarbonaceous feed containing hydrocarbons comprising at least 4 carbon atoms, which process comprises the following steps:

a) separating the feed by fractional distillation into a heavy fraction containing hydrocarbons comprising at least 7 carbon atoms, an intermediate fraction containing mainly hydrocarbons comprising 6 or 7 carbon atoms, and a light fraction containing hydrocarbons comprising at most 6 carbon atoms, b) isomerizing at least part of the light fraction, c) combining at least part of the effluent of step b) with at least part of the intermediate fraction, and separating off a stream containing normal hydrocarbons and a stream containing branched hydrocarbons, and d) passing at least part of the stream containing normal hydrocarbons to isomerization step b).

Suitably the process further comprises step e), in which at least part of the heavy fraction is catalytically reformed.

In an embodiment of the present invention, the process further comprises isomerizing at least part of the intermediate fraction, before the intermediate fraction is separated in separation step c) together with effluent of step b).

DETAILED DESCRIPTION OF THE INVENTION

In the process according to the present invention, the heavy fraction which can be subjected to catalytic reforming has a lower content of compounds which will be present in the product stream as benzene, such as (cyclo)hexanes and benzene itself, in comparison with a conventional isomerization process. However, the intermediate fraction of the process according to the present invention contains relatively heavy compounds which enhance coke make in conventional isomerization, resulting in deactivation of the catalyst. In the process according to the present invention the amount of hydrocarbons comprising 7 carbon atoms present in the intermediate fraction, is reduced by passing the fraction containing mainly hydrocarbons comprising 6 or 7 carbon atoms to the separation step before isomerization. As the branched as well as the cyclic hydrocarbons comprising 7 carbon atoms are removed in the separation step, the amount of hydrocarbons comprising 7 carbon atoms sent to the isomerization step, is reduced. Preferably, the intermediate fraction is isomerized before being sent to the separation step, resulting in an increased amount of branched $C_7$-hydrocarbons.

In order to prevent coke formation and subsequent catalyst deactivation, the isomerization of the intermediate fraction is preferably carried out at lower temperature than applied in conventional isomerization.

The feed which is sent to fractionation step a) contains hydrocarbons comprising at least 4 carbon atoms. Generally, the feed contains mainly hydrocarbon comprising at least 5 carbon atoms. Small amounts of lighter hydrocarbons can in some cases be present. For economic reasons, it can be advantageous that the separation carried out in the fractionation step is not carried out very strictly, which makes that some lighter and/or heavier compounds are also present in the heavy, the intermediate and/or the light fraction. Further, it can be advantageous to carry out the separation such that the non-cyclic hydrocarbons present in the intermediate fraction are mainly hydrocarbons containing 7 carbon atoms.

The catalytic reforming can suitably be carried out at a temperature of between 400° and 600° C. and a pressure of between 1 and 50 bar. Preferably, the heavy fraction is catalytically reformed by contacting with a reforming catalyst containing platinum and optionally at least one other metal.

For product finishing, effluent from reforming step e) is suitably distilled and separated into at least a stream containing hydrocarbons comprising at most 4 carbon atoms and a stream containing hydrocarbons comprising at least 4 carbon atoms.

A further enhancement of the octane number of the gasoline components finally obtained in the process according to the present invention, can be obtained by further processing at least part of the effluent of the reforming step to the separation step c), with or without previous isomerization. Preferably, at least part of the effluent of reforming step e) is distilled and separated into a stream containing hydrocarbons comprising at most 4 carbon atoms, a reformate stream containing mainly hydrocarbons comprising 5 to 7 carbon atoms and a stream containing hydrocarbons comprising at least 7 carbon atoms, at least part of which reformate stream is passed to separation step c), with or without previous isomerization.

Isomerization step b) is suitably carried out at a temperature between 100° and 320° C. and a pressure between 10 and 60 bar. The catalyst present in the isomerization step suitably is catalytically active in isomerization of hydrocarbons comprising 5 to 7 carbon atoms.

The intermediate fraction is suitably isomerized at a temperature between 50° and 300° C. and a pressure between 10 and 60 bar. Suitably, this isomerization is carried out at a lower temperature than isomerization step b). Suitably the isomerization is carried out by contacting with a catalyst which is catalytically active in isomerization of hydrocarbons comprising 6 or 7 carbon atoms. Preferably, the catalyst is catalytically active in isomerization of hydrocarbons comprising 6 or 7 carbon atoms and in hydrogenating aromatic compounds.

The catalyst employed in the isomerization step(s) suitably is a heterogeneous hydroisomerization catalyst having an acid activity and a hydrogenation activity and comprising one or more metals from Group VIII of the Periodic Table of the Elements on a carrier material. The carrier material has acidic properties and may suitably consist of silica-alumina, in particular zeolites (e.g. mordenite, faujasite or zeolite Y) in the hydrogen form or exchanged with rare earth ions, or of alumina rendered acidic by combination with halogen (e.g. chlorine). Preferably, the employed catalyst comprises at least one noble metal from Group VIII (in particular platinum) on mordenite as carrier material. Most preferably, a catalyst is used containing H-mordenite which is prepared by treating mordenite one or more times with an aqueous solution of an ammonium compound (e.g. ammonium nitrate), followed by drying (e.g. at 100°-200° C.) and calcining (e.g. at 400°-700° C.) of the treated mordenite. The catalyst can comprise a binder material such as alumina, silica or silica-alumina.

Suitably in separation step c) use is made of a separatory molecular sieve capable of separating a hydrocarbon species via selective adsorption. Suitably the molecular sieve which is applied is selective with respect to the degree of branching of the hydrocarbons applied, i.e. unbranched hydrocarbons should be substantially adsorbed, whereas branched and cyclic hydrocarbons should not be retained in any substantial amount in the molecular sieve. The selectivity is dependent to a large extent on the pore diameters of the molecular sieve. Suitably, in the separation step use is made of a separatory molecular sieve having a pore size which is sufficient to permit entry of normal hydrocarbons containing 4–7 carbon atoms, but restrictive to prohibit entry of such cyclic, mono-methyl branched and dimethyl branched hydrocarbons. Suitable pore diameters are in the range from 0.3–0.8 nm, and preferably from 0.4–0.6 nm. Synthetic or natural zeolites can be used as molecular sieve; preferably zeolite 5A is used. The particles which comprise molecular sieve material may in addition comprise a binder material such as alumina, silica or silica-alumina, in order to improve the crushing strength of the particles; said particles may also be mixed with particles which do not contain molecular sieve material.

The invention also relates to hydrocarbons whenever obtained by a process as described hereinbefore.

The process of the present invention can be carried out in a number of alternative ways, and some process schemes according to the present invention will be elucidated more fully hereinafter, with reference to the accompanying figures.

DETAILED DESCRIPTION OF THE DRAWINGS

Figure 1:
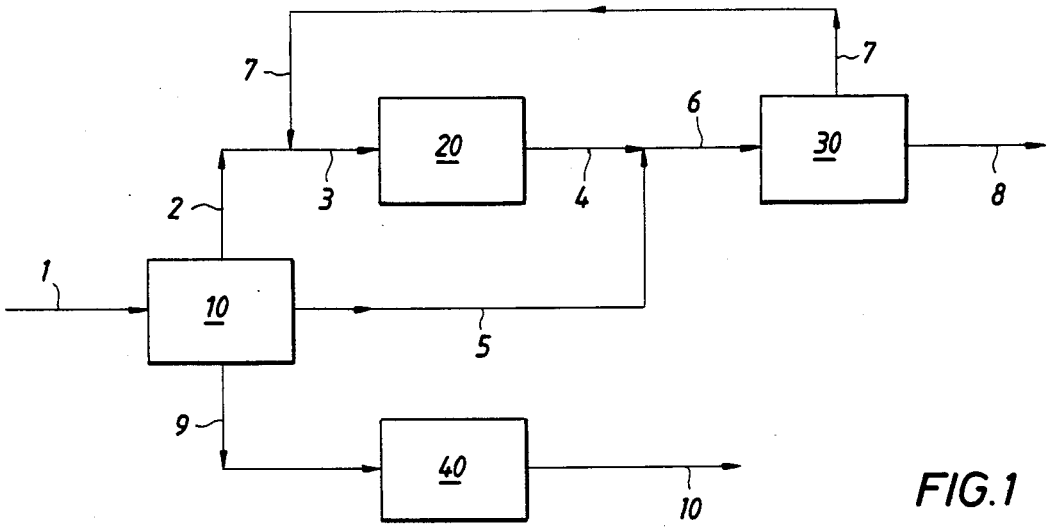
FIG. 1 is a flow scheme of the instant process.

The processes of the Figures are carried out with the help of a fractionation unit (10), a first isomerization unit (20), a separation unit (30), a reforming unit (40) and optionally a distillation unit (50) and/or a second isomerization unit (60).

In the process schematically shown in FIG. 1 a feed (1) is passed to fractionation unit (10). In fractionation unit (10) the feed is separated into a heavy fraction (9), containing hydrocarbons comprising at least 7 carbon atoms, an intermediate fraction (5), containing mainly hydrocarbons comprising 6 or 7 carbon atoms, and a light fraction (2), containing hydrocarbons comprising at most 6 carbon atoms. Light fraction (2) is sent to first isomerization unit (20) together with recycle stream (7), discussed hereinafter. Effluent of the isomerization unit (4) is sent to separation unit (30) together with intermediate fraction (5). Separation unit (30) comprises a separatory molecular sieve, with the help of which normal hydrocarbons are separated from cyclic and mono- and multi-branched hydrocarbons, thereby producing a stream (8), mainly comprising cyclic and branched hydrocarbons and a stream (7), mainly comprising normal hydrocarbons. Stream (7) is combined with stream (2) and sent to the isomerization unit (20). The heavy fraction (9) is sent to reforming unit (40), where the fraction is contacted with a reforming catalyst at reforming conditions.

Figure 2:
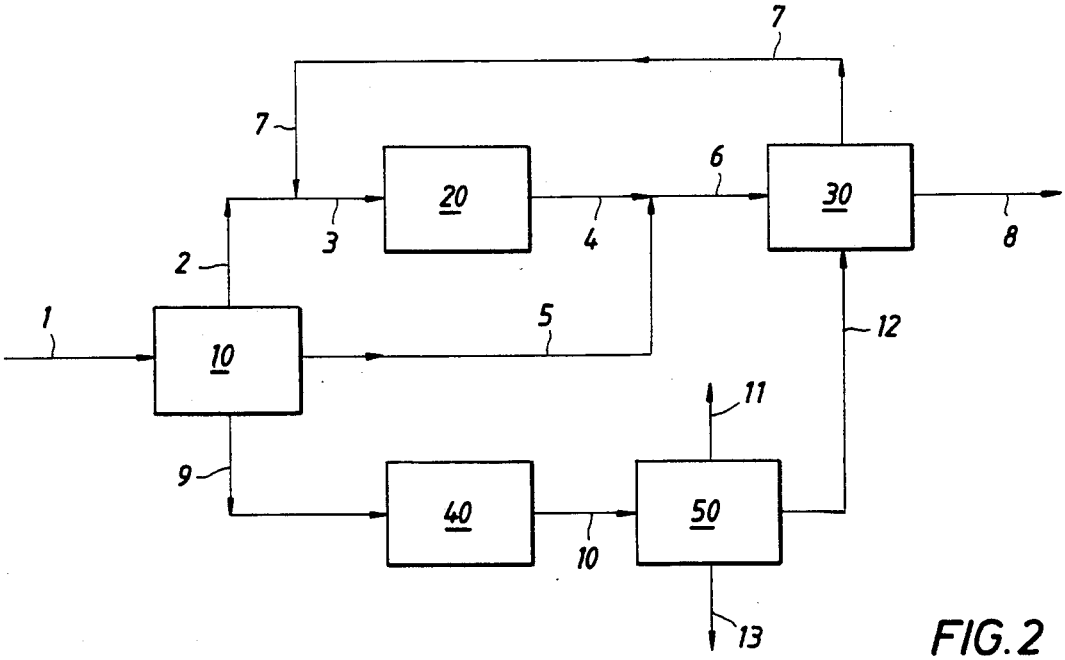
FIG. 2 is a flow scheme of the instant process showing alternative use of a distillation step subsequent to reforming.

The process schematically shown in FIG. 2 resembles the process schematically shown in FIG. 1. The processes differ in that in the process shown in FIG. 2 the effluent of the reforming unit (40) is sent to distillation unit (50), in which stream (10) is separated into a stream (11) containing hydrocarbons comprising at most 4 carbon atoms, a reformate stream (12) containing mainly hydrocarbons comprising 5 to 7 carbon atoms and a stream (13) containing hydrocarbons comprising at least 7 carbon atoms. The reformate stream (12) is sent, possibly together with streams (4) and/or (5) to separation unit (30).

Figure 3:
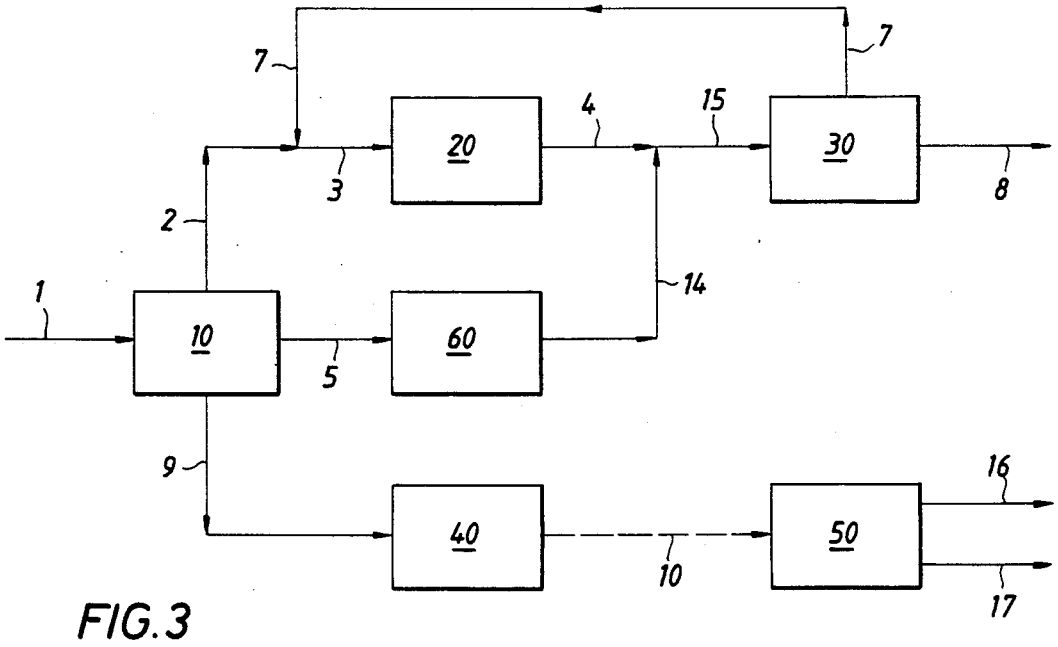
FIG. 3 is a flow scheme of the instant process showing alternative isomerization of the intermediate hydrocarbon fraction before combining with the first isomerization zone effluent.

In the process schematically shown in FIG. 3 a feed (1) is passed to fractionation unit (10). In fractionation unit (10) the feed is separated into a heavy fraction (9), containing hydrocarbons comprising at least 7 carbon atoms, an intermediate fraction (5), containing mainly hydrocarbons comprising 6 or 7 carbon atoms, and a light fraction (2), containing hydrocarbons comprising at most 6 carbon atoms. Light fraction (2) is sent to first isomerization unit (20) together with recycle stream (7), discussed hereinafter. Intermediate fraction (5) is sent to second isomerization unit (60). The effluent of the second isomerization unit (14) is sent, together with the effluent of the isomerization unit (4), to separation unit (30). Separation unit (30) comprises a separatory molecular sieve, with the help of which stream (8), mainly comprising branched and cyclic hydrocarbons, and a stream (7), mainly comprising normal hydrocarbons, are produced. Stream (7) is sent to the isomerization unit (20). Heavy fraction (9) is sent to reforming unit (40), in which the fraction is contacted with a reforming catalyst at reforming conditions. The effluent of the reforming unit (40) is sent to distillation unit (50), in which stream (10) is separated into a stream (16) containing hydrocarbons comprising at most 4 carbon atoms and a product stream (17).

Figure 4:
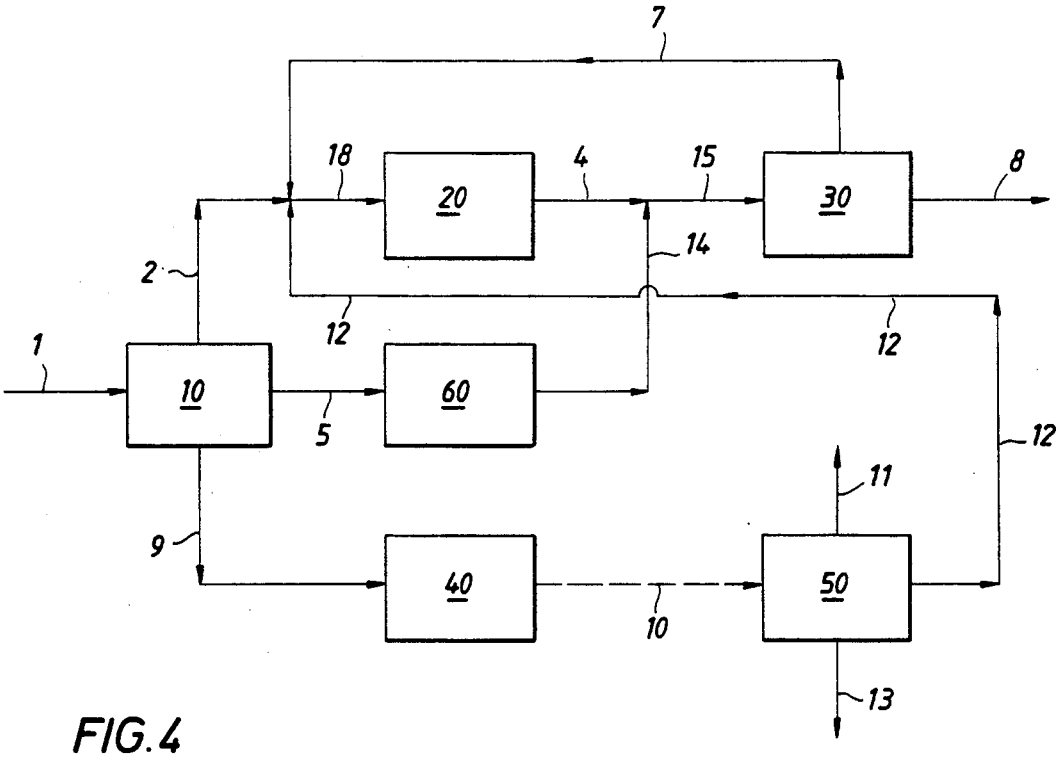
FIG. 4 is a flow scheme of the instant process where the reformate is separated and at least a portion is passed to the first isomerization zone.

The process shown in FIG. 4 differs from the process of FIG. 3, in that the effluent of reforming unit (40) is sent to distillation unit (50), in which stream (10) is separated into a stream (11) containing hydrocarbons comprising at most 4 carbon atoms, a reformate stream (12) containing mainly hydrocarbons comprising 5 to 7 carbon atoms and a stream (13) containing hydrocarbons comprising at least 7 carbon atoms. Reformate stream (12) is sent, together with streams (2) and (7), to the first isomerization unit (20).

The invention will now be further elucidated with the aid of the following examples, in which hydrogen addition and removal have not been indicated. The hydrocarbon feed used has a RON of 58 and a benzene content of 1.1% by weight.

EXAMPLE 1

The example is performed according to the process scheme of FIG. 1.

A feed containing 100 pbw of hydrocarbons which hydrocarbons comprise at least 4 carbon atoms, which feed had a final boiling point of 200° C. was split by fractional distillation into a heavy fraction boiling above 93° C. and containing 52 pbw of hydrocarbons, mainly hydrocarbons comprising at least 7 carbon atoms, and an intermediate fraction, boiling between 70° C. and 93° C. and containing 20 pbw of hydrocarbons, mainly hydrocarbons comprising 6 or 7 carbon atoms, and a light fraction boiling below 70° C. and containing 28 pbw of hydrocarbons, mainly hydrocarbons comprising at most 6 carbon atoms. The light fraction was combined with stream (7) and isomerized at a temperature of 260° C. and a pressure of 25 bar in the presence of a catalyst containing 0.3 pbw of platinum on mordenite, amount of metal on amount of mordenite. Hydrocarbons comprising at most 4 carbon atoms were removed from the effluent obtained and the remaining effluent was combined with the intermediate fraction and separated in a separation unit with the help of 5A zeolite as separatory molecular sieve, by which a stream containing branched and cyclic hydrocarbons was separated off, containing 45 pbw of hydrocarbons and 2.1% by weight (% wt) of benzene, and a stream containing normal hydrocarbons containing 14 pbw of hydrocarbons. The stream containing normal hydrocarbons was combined with the light fraction.

The heavy fraction was reformed at a temperature of 500° C. and a pressure of 8 bar in the presence of a catalyst containing 0.3 pbw of platinum on alumina (amount of metal on amount of alumina). Hydrocarbons comprising at most 4 carbon atoms were removed, and effluent containing 47 pbw of hydrocarbons and 0.8% by weight of benzene was obtained.

In the above process in total 92 pbw of hydrocarbons comprising at least 5 carbon atoms was produced, which hydrocarbons had a benzene content of 1.4% wt and a RON of 90.

EXAMPLE 2

This example was performed according to the process scheme of FIG. 2.

A feed containing 100 pbw of hydrocarbons which hydrocarbons comprise at least 4 carbon atoms, which feed had a final boiling point of 200° C., was split by fractional distillation into a heavy fraction boiling above 93° C. and containing 52 pbw of hydrocarbons, mainly hydrocarbons comprising at least 7 carbon atoms and an intermediate fraction, boiling between 70° C. and 93° C. and containing 20 pbw of hydrocarbons, mainly hydrocarbons comprising 6 or 7 carbon atoms, and a light fraction boiling below 70° C. and containing 28 pbw of hydrocarbons, mainly hydrocarbons comprising at most 6 carbon atoms. The light fraction was combined with stream (7) and isomerized at a temperature of 260° C. and a pressure of 25 bar in the presence of a catalyst containing 0.3 pbw of platinum on mordenite (amount of metal on amount of mordenite). Hydrocarbons comprising at most 4 carbon atoms were removed from the effluent obtained and the remaining effluent was combined with the intermediate fraction and reformate stream (12), discussed hereinafter, and separated in a separation unit with the help of 5A zeolite as separatory molecular sieve, by which a stream containing branched and cyclic hydrocarbons was separated off, containing 53 pbw of hydrocarbons and 2.5% wt of benzene, and a stream containing normal hydrocarbons, containing 17 pbw of hydrocarbons. The stream containing normal hydrocarbons was combined with the light fraction.

The heavy fraction was reformed at a temperature of 500° C. and a pressure of 8 bar in the presence of a catalyst containing 0.3 pbw of platinum on alumina (amount of metal on amount of alumina). Hydrocarbons comprising at most 4 carbon atoms were removed, which stream contained 3 pbw of hydrocarbons; a reformate stream containing hydrocarbons comprising 5 to 7 carbon atoms, which stream contained 9 pbw of hydrocarbons; and a stream containing hydrocarbons comprising at least 7 carbon atoms, which latter stream contained 38 pbw of hydrocarbons and 0.0% wt of benzene.

In the above process in total 91 pbw of hydrocarbons comprising at least 5 carbon atoms was produced, which hydrocarbons had a benzene content of 1.5% wt and a RON of 91.

EXAMPLE 3

This example was performed according to the process scheme of FIG. 3.

A feed containing 100 pbw of hydrocarbons which hydrocarbons comprised at least 4 carbon atoms, which feed has a final boiling point of 200° C. was split by fractional distillation into a heavy fraction boiling above 93° C. and containing 52 pbw of hydrocarbons, mainly hydrocarbons comprising at least 7 carbon atoms and an intermediate fraction, boiling between 70° C. and 93° C. and containing 20 pbw of hydrocarbons, mainly hydrocarbons comprising 6 or 7 carbon atoms, and a light fraction boiling below 70° C. and containing 28 pbw of hydrocarbons, mainly hydrocarbons comprising at most 6 carbon atoms. The light fraction was combined with stream (7) and isomerized at a temperature of 260° C. and a pressure of 25 bar in the presence of a catalyst containing 0.3 pbw of platinum on mordenite, amount of metal on amount of mordenite. The intermediate fraction was isomerized at a temperature of 220° C. and a pressure of 25 bar in the presence of a catalyst containing 0.3 pbw of platinum on mordenite. Hydrocarbons comprising at most 4 carbon atoms were removed from the effluents obtained, and the remaining effluents were combined and separated in a separation unit with the help of 5A zeolite as separatory molecular sieve, by which a stream containing branched and cyclic hydrocarbons was separated off, containing 45 pbw of hydrocarbons and 0.0% wt of benzene, and a stream containing normal hydrocarbons, containing 12 pbw of hydrocarbons. The stream containing normal hydrocarbons was combined with the light fraction.

The heavy fraction was reformed at a temperature of 500° C. and a pressure of 8 bar in the presence of a catalyst containing 0.3 pbw of platinum on alumina (amount of metal on amount of alumina). Hydrocarbons comprising at most 4 carbon atoms were removed, and effluent containing 47 pbw of hydrocarbons and 0.8% by weight of benzene was obtained.

In the above process in total 92 pbw of hydrocarbons comprising at least 5 carbon atoms was produced, which hydrocarbons had a benzene content of 0.4% wt and a RON of 90.

EXAMPLE 4

This process scheme was performed according to the process scheme of FIG. 4.

A feed containing 100 pbw of hydrocarbons which hydrocarbons comprised at least 4 carbon atoms, which feed had a final boiling point of 200° C. was split by fractional distillation into a heavy fraction boiling above 93° C. and containing 52 pbw of hydrocarbons, mainly hydrocarbons comprising at least 7 carbon atoms and an intermediate fraction, boiling between 70° C. and 93° C. and containing mainly hydrocarbons comprising 6 or 7 carbon atoms, and a light fraction boiling below 70° C. and containing 28 pbw of hydrocarbons, mainly hydrocarbons comprising at most 6 carbon atoms. The light fraction was combined with stream (7) and stream (12) discussed hereinafter, and were together isomerized at a temperature of 260° C. and a pressure of 25 bar in the presence of a catalyst containing 0.3 pbw of platinum on mordenite, amount of metal on amount of mordenite. The intermediate fraction was isomerized at a temperature of 220° C. and a pressure of 25 bar in the presence of a catalyst containing 0.3 pbw of platinum on mordenite. Hydrocarbons comprising at most 4 carbon atoms were removed from the effluents obtained, and the remaining effluents were combined and separated in a separation unit with the help of 5A zeolite as separatory molecular sieve, by which a stream containing branched and cyclic hydrocarbons was separated off, containing 51 pbw of hydrocarbons and 0.0% by weight (% wt) of benzene, and a stream containing normal hydrocarbons, containing 13 pbw of hydrocarbons. The stream containing normal hydrocarbons was combined with the light fraction.

The heavy fraction was reformed at a temperature of 500° C. and a pressure of 8 bar in the presence of a catalyst containing 0.3 pbw of platinum on alumina (amount of metal on amount of alumina). Hydrocarbons comprising at most 4 carbon atoms were removed, which stream contained 3 pbw of hydrocarbons; a reformate stream containing hydrocarbons comprising 5 to 7 carbon atoms, which stream contained 9 pbw of hydrocarbons; and a stream containing hydrocarbons comprising at least 7 carbon atoms, which latter stream contained 38 pbw of hydrocarbons and 0.0% wt of benzene.

In the above process in total 90 pbw of hydrocarbons comprising at least 5 carbon atoms was produced, which hydrocarbons had a benzene content of 0.0% wt and a RON of 91.

EXAMPLE 5

This is a comparative example relevant to Examples 1–4.

A feed containing 100 pbw of hydrocarbons comprising at least 4 carbon atoms, which feed had a final boiling point of 200° C., was split by fractional distillation into a heavy fraction boiling above 70° C. and containing 72 pbw of hydrocarbons, substantially all of which hydrocarbons comprised at least 6 carbon atoms and a light fraction boiling below 70° C. and containing 28 pbw of hydrocarbons, substantially all of which hydrocarbons comprised at most 6 carbon atoms. The light fraction was isomerized in a first isomerization step at a temperature of 260° C. and a pressure of 25 bar in the presence of a catalyst containing 0.3 pbw of platinum on mordenite (amount of metal on amount of mordenite). Hydrocarbons comprising at most 4 carbon atoms were removed from the effluent obtained and the remaining effluent was separated with the help of zeolite 5A as separatory molecular sieve. A stream containing branched and cyclic hydrocarbons was separated off, which stream contained 26 pbw of hydrocarbons and 0.0% wt of benzene, and a stream containing normal hydrocarbons, which latter stream contained 9 pbw of hydrocarbons.

The heavy fraction was reformed at a temperature of 500° C. and a pressure of 8 bar, with the help of a catalyst containing 0.3 pbw of platinum on alumina (amount of platinum on amount of alumina). The effluent obtained was distilled to give a stream containing hydrocarbons comprising at most 4 carbon atoms, which stream contained 4 pbw of hydrocarbons, and a stream containing hydrocarbons comprising at least 4 carbon atoms, which latter stream contained 66 pbw of hydrocarbons and 9.7% by weight of benzene.

In the above process in total 92 pbw of hydrocarbons comprising at least 5 carbon atoms was produced, which hydrocarbons had a benzene content of 6.9% wt and a RON of 93.

What I claim as my invention is:

1. A process for producing gasoline components from a hydrocarbonaceous feed containing hydrocarbons comprising at least 4 carbon atoms, which comprises:

a) passing said feed to a first separation zone to separate said feed by fractional distillation into (i) a heavy fraction containing hydrocarbons having at least 7 carbon atoms, (ii) an intermediate fraction containing hydrocarbons having 6 or 7 carbon atoms, and (iii) a light fraction containing hydrocarbon having at most 6 carbon atoms.

b) passing said light fraction to a first isomerization zone to isomerize said light fraction to produce a first isomerization zone effluent stream, wherein said first isomerization zone is operated at a temperature between 100° and 320° C. and a pressure between 10 and 60 bar;

c) combining said first isomerization zone effluent stream with said intermediate fraction to form a first combined stream and passing said first combined stream to a second separation zone;

d) separating said first combined stream in said second separation zone to form a stream containing normal hydrocarbons and a stream containing branched hydrocarbons; and e) passing at least a portion of said normal hydrocarbons to said first isomerization zone.

2. The process of claim 1 which comprises passing said heavy fraction to a reforming zone and reforming said heavy fraction to produce a reformate effluent stream.

3. The process of claim 1 wherein said intermediate stream, prior to combination with said first isomerization zone effluent stream, is passed to a second isomerization zone to produce a second isomerization effluent stream which is then combined with said first isomerization zone effluent stream to form said first combined stream wherein said second isomerization zone is operated at a temperature between 50° and 300° C. and a pressure between 10 and 60 bar.

4. The process according to claim 1 wherein said intermediate fraction contains hydrocarbons having 7 carbon atoms.

5. The process according to claim 2 wherein said reformate effluent stream is passed to a third separation zone and is separated into three streams comprising:

1) a third separation zone first stream containing hydrocarbons having at most 4 carbon atoms,
2) a third separation zone second stream containing hydrocarbons having 5 to 7 carbon atoms, and
3) at third separation zone third stream containing hydrocarbons having at least 7 carbon atoms.

6. The process of claim 5 wherein said third separation zone second stream having 5 to 7 carbon atoms is passed to said first separation zone.

7. The process of claim 5 wherein said third separation zone second stream having 5 to 7 carbon atoms is passed to combine with said light fraction to form a second combined stream which is passed to said first isomerization zone.

8. The process of claim 1 wherein said first isomerization zone contains an isomerization catalyst catalytically active to isomerize hydrocarbons containing $C_6$ or $C_7$ carbon atoms and in hydrogenating aromatic compounds.

9. The process of claim 1 wherein said second separation zone comprises a separatory molecular sieve capable of separating normal hydrocarbons from branched hydrocarbons via selective adsorption.

10. The process of claim 9 wherein said molecular sieve has a pore size sufficient to permit entry of normal hydrocarbons but restrictive to prohibit entry of monomethyl branched hydrocarbons, diemthyl branched hydrocarbons and cyclic hydrocarbons.

* * * * *